US010010906B2

(12) United States Patent
Dellea et al.

(10) Patent No.: US 10,010,906 B2
(45) Date of Patent: Jul. 3, 2018

(54) PROCESS FOR DEPOSITING A COMPACT FILM OF PARTICLES ON THE INTERNAL SURFACE OF A PART HAVING A HOLLOW DELIMITED BY THIS INTERNAL SURFACE

(71) Applicant: COMMISSARIAT A L'ENERGIE ATOMIQUE ET AUX ENERGIES ALTERNATIVES, Paris (FR)

(72) Inventors: Olivier Dellea, La Talaudiere (FR); Philippe Coronel, Barraux (FR); Pascal Fugier, Bernin (FR)

(73) Assignee: Commissariat à l'énergie atomique et aux énergies alternatives, Paris (FR)

( * ) Notice: Subject to any disclaimer, the term of this patent is extended or adjusted under 35 U.S.C. 154(b) by 283 days.

(21) Appl. No.: 14/890,016

(22) PCT Filed: May 12, 2014

(86) PCT No.: PCT/EP2014/059653
§ 371 (c)(1),
(2) Date: Nov. 9, 2015

(87) PCT Pub. No.: WO2014/184138
PCT Pub. Date: Nov. 20, 2014

(65) Prior Publication Data

US 2016/0279666 A1 Sep. 29, 2016

(30) Foreign Application Priority Data

May 13, 2013 (FR) ..... 13 54262

(51) Int. Cl.
*B05D 7/22* (2006.01)
*B05D 1/20* (2006.01)
(Continued)

(52) U.S. Cl.
CPC ..... *B05C 19/005* (2013.01); *B05C 3/10* (2013.01); *B05C 3/109* (2013.01); *B05C 7/04* (2013.01);
(Continued)

(58) Field of Classification Search
CPC ..... B05D 1/20; B05D 1/202; B05D 1/204; B05D 1/24; B05D 7/22; B05D 7/222;
(Continued)

(56) References Cited

U.S. PATENT DOCUMENTS 7,804,134 B2 9/2010 Coronel
8,389,050 B2 * 3/2013 Buck ..... B01J 37/0221 427/181
(Continued)

FOREIGN PATENT DOCUMENTS

WO 2010/059682 A1 5/2010

OTHER PUBLICATIONS

U.S. Appl. No. 14/001,088, filed Aug. 22, 2013, 2013-0330471, Dellea.
(Continued)

*Primary Examiner* — William P Fletcher, III
(74) *Attorney, Agent, or Firm* — Oblon, McClelland, Maier & Neustadt, L.L.P.

(57) ABSTRACT

A process for depositing a compact film of particles on an internal surface of a part, including: a) placing the part in a carrier liquid; b) generating a carrier liquid stream in a hollow of the part towards a surface of the carrier liquid, to create a protuberance; c) dispensing the particles to form a compact film floating on the liquid between a contact line and an upstream front of particles; and d) transferring the film onto the internal surface by operating a relative dis-
(Continued)

placement between the part and the surface of the carrier liquid, while continuing dispensing the particles on the upstream front.

15 Claims, 3 Drawing Sheets

(51) Int. Cl.

| | |
|---|---|
| ***B05C 19/00*** | (2006.01) |
| ***B05C 7/04*** | (2006.01) |
| ***B05C 9/02*** | (2006.01) |
| ***B05D 1/24*** | (2006.01) |
| ***B05C 3/10*** | (2006.01) |
| ***B05C 3/109*** | (2006.01) |
| ***B05D 7/00*** | (2006.01) |

(52) U.S. Cl.
CPC ..... *B05C 9/02* (2013.01); *B05C 19/008* (2013.01); *B05D 1/20* (2013.01); *B05D 1/202* (2013.01); *B05D 1/204* (2013.01); *B05D 1/24* (2013.01); *B05D 7/22* (2013.01); *B05D 7/222* (2013.01); *B05D 7/50* (2013.01)

(58) Field of Classification Search
CPC .... B05C 7/00; B05C 7/04; B05C 9/00; B05C 9/02; B05C 19/005; B05C 19/008
USPC ..... 118/303, 401, 408, 417; 427/182, 185, 427/230, 255.25, 434.3
See application file for complete search history.

(56) References Cited

U.S. PATENT DOCUMENTS

| | | | |
|---|---|---|---|
| 2010/0129545 | A1 | 5/2010 | Buck et al. |
| 2013/0330471 | A1 | 12/2013 | Dellea |
| 2014/0147583 | A1 | 5/2014 | Dellea |
| 2014/0158334 | A1 | 6/2014 | Dellea |
| 2014/0356528 | A1 | 12/2014 | Dellea |
| 2014/0374930 | A1 | 12/2014 | Dellea |
| 2015/0010693 | A1 | 1/2015 | Dellea |
| 2015/0044809 | A1 | 2/2015 | Dellea |
| 2015/0084480 | A1 | 3/2015 | Savelli |
| 2015/0115769 | A1 | 4/2015 | Savelli |
| 2015/0217328 | A1 | 8/2015 | Dellea |

OTHER PUBLICATIONS

U.S. Appl. No. 14/128,266, filed Feb. 25, 2014, 2014-0158334, Dellea.
U.S. Appl. No. 14/131,082, filed Jan. 6, 2014, 2014-0147583, Dellea.
U.S. Appl. No. 14/232,092, filed Apr. 3, 2014, 2015-0115769, Savelli.
U.S. Appl. No. 14/369,752, filed Jun. 30, 2014, 2014-0356528, Dellea.
U.S. Appl. No. 14/375,532, filed Jul. 30, 2014, 2015-0010693, Dellea.
U.S. Appl. No. 14/375,858, filed Jul. 31, 2014, 2014-0374930, Dellea.
U.S. Appl. No. 14/375,994, filed Jul. 31, 2014, 2015-0044809, Dellea.
U.S. Appl. No. 14/398,340, filed Oct. 31, 2014, 2015-0084480, Savelli.
U.S. Appl. No. 14/423,957, filed Feb. 25, 2015, 2015-0217328, Dellea.
U.S. Appl. No. 14/892,473, filed Nov. 19, 2015, Aliane.
U.S. Appl. No. 14/890,016, filed Nov. 9, 2015, Dellea.
U.S. Appl. No. 14/890,857, filed Nov. 12, 2015, Dellea.
U.S. Appl. No. 14/887,831, filed Oct. 20, 2015, Fenouillet-Beranger.
Dimitrov, A., et al., "Continuous Convective Assembling of Fine Particles into Two-Dimensional Arrays on Solid Surfaces", Langmuir, vol. 12, pp. 1303-1311, (1996).
Kinge, S., et al., "Self-Assembling Nanoparticles at Surfaces and Interfaces", ChemPhysChem, vol. 9, No. 1, (2008) (Abstract only).
International Search Report dated Oct. 14, 2014 in PCT/EP14/59653 filed May 12, 2014.
French Search Report dated Jan. 23, 2014 in FR1354262 filed May 13, 2013.

* cited by examiner

PROCESS FOR DEPOSITING A COMPACT FILM OF PARTICLES ON THE INTERNAL SURFACE OF A PART HAVING A HOLLOW DELIMITED BY THIS INTERNAL SURFACE

The invention relates to the field of processes and facilities for depositing a compact film of particles on the internal surface of a part having a hollow delimited by this surface. This can for example be a deposition of ordered particles on the internal surface of a tubular part.

Preferably, it relates to the deposition of a film of ordered solid particles having a size between a few nanometers and several hundreds micrometers. The solid particles, being preferably of a spherical shape, can for example be silica particles.

The invention has applications in various technical fields, as for example in the field of lighting and decorative objects, or even that of surface structuring.

In prior art, there is only a small number of techniques for depositing a compact film of particles on the internal surface of a part. One of them is described in the document entitled "*Continuous Convective Assembling of Fine Particles into Two-Dimensional Arrays on Solid Surfaces", Langmuir* 1996, 12 1303-1311, Dimitrov and Nagayama. This technique generally consists in vertically placing the part in a colloidal suspension bath, and removing it slowly as the bath evaporates. This evaporation at the contact line between the bath and the internal surface of the part creates a convective liquid stream, which drives the bath particles to this same contact line. This initiates an array of particles which becomes compact because of the capillarity forces which attract the particles to each other.

The part withdrawal rate should be very precisely controlled such that it is constant and equivalent to the growth rate of the array of particles, in turn depending on the bath evaporation rate. Thus, this deposition technique is particularly hard to control because of the great number of parameters to be taken into account, to succeed in obtaining the deposition of a film with a good quality on the internal surface of the part.

In parallel, the implementation of this technique is of course limited to the use of colloidal solutions, and thus does not offer great diversity in the nature of the particles likely to be deposited.

Finally, the controlled deposition of a heterogeneous compact film is complicated, because it requires a full bath drainage as soon as the nature and/or dimension of the particles comes to change.

To overcome at least partly these drawbacks, one object of the invention is first to provide a process for depositing a compact film of particles on the internal surface of a part having a hollow delimited by this internal surface, the process comprising the following steps of:

a) placing said part in a carrier liquid so as to define a contact line between a surface of this carrier liquid and the internal surface of the part;

b) generating a carrier liquid stream in said hollow of the part towards the surface of the carrier liquid, such that this surface of the carrier liquid has a protuberance;

c) dispensing the particles at the surface of the carrier liquid so as to generate a compact film of particles floating on the carrier liquid between said contact line and an upstream front of particles arranged around the protuberance; and d) transferring the compact film of particles onto the internal surface of the part by operating a relative displacement between this part and the surface of the carrier liquid, while continuing dispensing the particles on said upstream front surrounding the protuberance at the surface of the carrier liquid.

The invention is remarkable in that it offers a large choice in the nature of the particles likely to be deposited on the internal surface of the part. In particular, the invention is not limited to the use of colloidal solutions.

Further, the invention is simple to implement in comparison with the technique of prior art described below. This is explained by the principle retained, which takes advantage of the surface current and the protuberance slope to order the particles before they are deposited onto the internal surface. Indeed, first, the presence of the stream generating the protuberance implies that the current at the surface of the carrier liquid prompts the particles contacting it to be radially outwardly directed, towards the contact line forming a stop for the same particles. Moreover, by virtue of the presence of the protuberance, the particles present on the same are also radially outwardly led by gravity, because of the slope defined by this protuberance. Thus, these two combined effects bring the energy required for ordering the particles against the contact line. They are thus judiciously retained for creating, at the surface of the carrier liquid, the compact film of particles the concept of which is for example disclosed in document *Sachin Kinge, "Self-Assembling Nanoparticles at Surfaces and Interfaces", Chem Phys Chem* 2008, 9, 20-42.

The principle suggested by the invention also facilitates a controlled deposition of a heterogeneous compact film. To obtain such a heterogeneous film, it is sufficient to vary the nature and/or dimension of the particles dispensed at the surface of the carrier liquid.

Preferably, the invention also comprises a step for placing, in the protuberance, an element for enhancing the slope defined by this protuberance, said slope enhancing element having an external surface with a cross-section narrowing in a direction opposite to that of said carrier liquid stream generated in the hollow of the part. Preferably, the enhancing element has a conical or frustoconical shaped external surface.

This simply enables the slope of the protuberance on which the particles float to be enhanced, and thus enhances the displacement effect of these particles towards the contact line. Consequently, this slope enhancing element enables the pressure of the ordered particles against the contact line to be enhanced, without requiring an increase in the power of the carrier liquid stream generated in the hollow of the part. Accordingly, the protuberance stability is advantageously improved.

Preferably, said protuberance and said enhancing element are coaxial, preferably centred in said hollow of the part.

Preferably, the step for generating the carrier liquid stream in said hollow is made using a liquid spraying port arranged in said hollow. To yet further decrease the instability risks of the protuberance and possible surface turbulences, the spraying port is covered with one or more grids.

Preferably, the process also comprises, simultaneously with the step for generating the carrier liquid stream in said hollow, a step of sucking said carrier liquid, a sucking port being preferentially arranged in said hollow. Alternatively, this sucking port can be located outside the hollow. To obtain a carrier liquid surface remaining at a same level during the implementation of the process, the liquid spraying and liquid sucking flow rates are preferably substantially identical.

The spraying port and the sucking port can respectively communicate with the outlet and the inlet of a pump. They thus can be a part of a same hydraulic circuit.

Preferably, the step of transferring the compact film is implemented by displacing said part.

Alternatively, this step of transferring the compact film is implemented by lowering the surface of the carrier liquid in the part remaining fixed. A solution combining both preceding ones is also contemplatable, without departing from the scope of the invention. In the second solution for lowering the surface of the carrier liquid in the part, other elements of the facility as the spraying/sucking ports can be simultaneously displaced with the liquid level.

Preferably, the step for dispensing the particles is made using one or more possibly movable nozzles. The purpose is to achieve a relatively even dispensing all around the protuberance. Consequently, an annular nozzle centred on the protuberance can also be contemplated, without departing from the scope of the invention. Alternatively, the nozzle could feed a dispenser providing uniform dispensing of particles throughout the protuberance.

For example, the process is applicable to a tubular part.

More generally, the cross-section of the internal surface of the part can be of any shape, symmetrical or dissymmetrical, for example circular, square, or even integrating concave and/or convex portions, or even have acute, right or obtuse angles. Moreover, the internal cross-section can be changing in size and/or shape. On the other hand, the hollow can extend along a straight line to form a tubular part, or extend along a non-straight line, for example curved, pecked, etc. Finally, the hollow of the part to be coated can be an open hollow or a through hollow, without departing from the scope of the invention.

Preferably, said particles of the compact film have a major diameter in the order of 1 nm to 500 μm.

Preferably, the compact film of particles deposited on the internal surface of the part is homogeneous or heterogeneous. In the latter case, particles having different sizes and/or different compositions make up the film. On the other hand, it is possible to coat the internal surface of the part by alternating coated portions and non-coated portions, for example to form periodical film interruptions along the internal surface delimiting the hollow.

For example, the group of steps a) to d) is repeated for depositing several identical or different superimposed films. Therefore, this is a multilayer coating deposited on the internal surface delimiting the hollow.

Finally, the method also preferably comprises a step for depositing a compact film of particles on the external surface of the part, simultaneously, before or after the deposition of the compact film on the internal surface of the part. In this case, all the deposition techniques meant to be suitable are contemplatable, in particular those ensuring a prior formation of a compact film of particles at the surface of a carrier liquid, before this film is transferred onto a substrate.

One object of the invention is also to provide a facility for implementing the process as described above, comprising:

- a container holding the carrier liquid;
- means for generating the carrier liquid stream in said hollow of the part, towards the surface of the carrier liquid;
- means for dispensing the particles at the surface of the carrier liquid; and
- means for operating a relative displacement between the part and the surface of the carrier liquid.

Further advantages and characteristics of the invention will appear in the non-limiting detailed description below.

This description will be made with regard to the appended drawings from which

Figure 1:
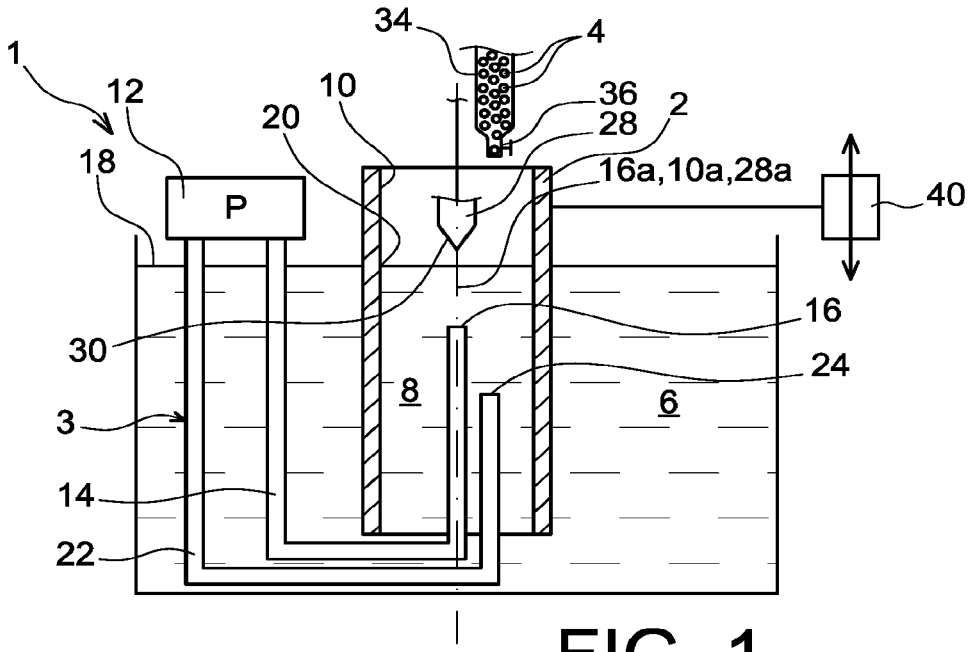
FIG. 1 shows a facility for the implementation of a method for depositing a compact film of particles, according to a preferred embodiment of the present invention.

In reference first to FIG. 1, a facility 1 for depositing a compact film of particles on the internal surface of a part 2 is represented.

The facility comprises a container 3 holding a carrier liquid 6. This is preferably deionized water, on which the particles can float.

According to an alternative, the part 2 and the container 3 can be integral.

The facility also includes means for generating a carrier liquid stream in the hollow 8 of the part 2 defined by its internal surface 10. The means here comprise a pump 12 connected to a piping 14 at the end of which is located a liquid spraying port 16, directed towards the surface 18 of the carrier liquid 6. More precisely, the port 16 placed in the liquid 6 is directed so as to create a stream orthogonal to the liquid surface, this stream being thus vertical. Moreover, the spraying port 16 is centred in the hollow 8 of the part, which is here a tubular part the internal surface 10 of which has a circular cross-section. Thus, the axis 16*a* of the port 16 is the same as the axis 10*a* of the internal surface 10 of the part 2 partly soaked in the carrier liquid 6 of the container 3.

Besides, it is noted that a contact line 20 is defined at the interface between the internal surface 10 of the part and the surface 18 of the carrier liquid 6.

Further, the pump 12 is connected at its inlet to a piping 22 at the end of which is located a liquid sucking port 24. This port can be placed in the hollow 8 as represented in FIG. 1, or outside the part 2, still in the container. Hence, the liquid 6 sucked by the port 24 passes through the pump 12 before being ejected into the hollow 8 by the port 16. It is noted that to limit the turbulence within the hollow 8, the sucking port is actually placed preferentially outside this hollow 8 in which the liquid stream is to be generated, for forming a protuberance at the surface.

As will be described hereinafter, the aforesaid protuberance is provided to form a slope in which the particles to be deposited can be displaced by gravity and following the surface current lines directed radially outwards.

To yet further improve these effects for displacing the particles against the contact line 20, the facility 1 further includes an element for enhancing the slope defined by this protuberance. This element is here a pin 28 having a conical external surface 30 with a cross-section narrowing to the bottom of the container. In other words, the cross-section of the conical surface 30 is narrowed in a direction opposite to that of the carrier liquid stream propagation to be generated in the hollow 8, at the outlet of the port 16.

The pin 28 is arranged coaxial to the spraying port 16. Its axis 28*a* is thus the same as the axes 16*a* and 10*a*, and also the same as the axis of the protuberance to be formed at the surface 18 of the carrier liquid.

When the protuberance is formed, the pin 28 coaxially penetrates the same so as to enhance the slope of this protuberance on which the particles are intended to float. By this enhancement, the displacement effect of these particles towards the contact line 20 is enhanced.

Further, the conical surface 30 enables surface current lines to be symmetrically drifted, enabling an even pressure to be obtained at the periphery.

The pin 28 can penetrate the protuberance of the carrier liquid beyond its conical surface 30. It is made of a hydrophobic material for preventing particles from being deposited onto its conical surface 30. The material retained is for example Teflon (PTFE).

The facility 1 includes on the other hand means 34 for dispensing particles 4 at the surface 18 of the carrier liquid 6. The size of the particles 4 can be between a few nanometers and several hundreds micrometers. The solid particles, being preferably of a spherical shape, can for example be silica particles. Other particles of interest can be made of metal or metal oxide as platinum, TiO2, polymer as polystyrene or PMMA, carbon, etc. They can also be chemical molecules. Other examples are glass fibres, PTFE particles, epoxy, Janus-type particles, or even so-called core-shell particles.

More precisely, in the preferred embodiment, the particles are silica spheres about 1 μm in diameter, stored in solution in the dispensing device 34. The proportion of the medium is about 7 g of particles per 200 ml of solution, here butanol. Of course, for the sake of clarity, the particles represented in the figures assume a diameter higher than their actual diameter.

The dispensing device 34 has one or more controllable injection nozzles 36, about 500 μm in diameter. Indeed, only one nozzle 36 has been represented in FIG. 1, but it is preferentially desired to have a substantially uniform dispensing of particles about the axis 10*a*, towards the surface 18. For this, several nozzles 36 can be provided distributed about the axis 10*a*, or one or more movable nozzles along a circular trajectory centred on this same axis 10*a*.

Finally, the facility includes means 40 for operating a relative displacement between the part 2 and the surface 18 of the carrier liquid 6. In this embodiment, the means 40 enable the part 2 to be vertically displaced, along its axis 10*a*, with the container 3 and its equipment remaining fixed. Conventional motor mechanical means can be used to manufacture these means 40.

A process for depositing a compact film of particles 4, on the internal surface 10 of the part 2, will now be described in reference to FIGS. 1 to 5.

First, as shown in FIG. 1, the part 2 is partly immersed in the carrier liquid 6, so as to define the contact line 20 between both surfaces 10, 18.

Figure 2:
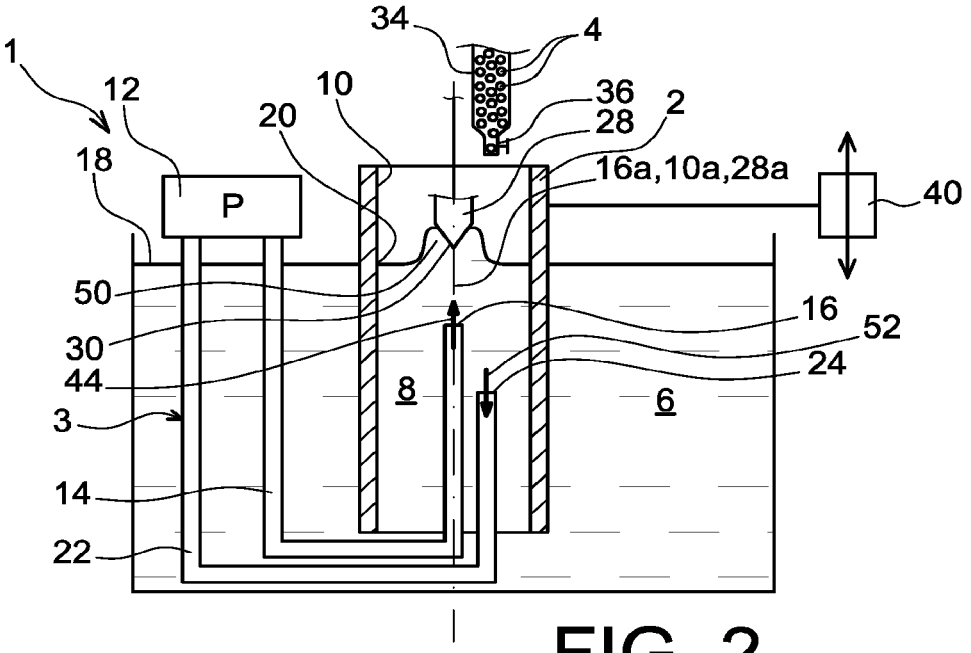
FIGS. 2 to 5 represent different steps of a deposition process implemented using the facility shown in the preceding figure, according to a preferred embodiment.

Then, as is schematized in FIG. 2, the pump 12 is actuated so as to generate the carrier liquid stream 44 in the hollow 8, at the outlet of the spraying port 16. This stream 44, directed vertically upwards, causes a protuberance 50 on the liquid surface 18. Thus, it extends upwardly and is centred on the axes 10*a*, 16*a*, 28*a*. The protuberance 50 has generally the form of a dome, through the centre of which passes the pin 28 which enhances the slope of this dome relative to the horizontal adjacent part of the surface 18 of the carrier liquid. The protuberance 50 is separated from this horizontal adjacent part by a partition line 58, located more or less close to the internal surface 10 and centred in the hollow 8.

It is noted that for the formation of an as-stable-as-possible protuberance 50, without turbulences detrimental for the subsequent steps of flowing the particles, the spraying port 16 is covered with one or more grids (not represented). These can be stainless steel grids, for example with a square mesh having a 1 mm pitch.

This configuration with the protuberance 50 represented in FIG. 2 is held throughout the implementation of the process, and accompanied in parallel by a step of continuously sucking the liquid 6 through the dedicated port 24. This sucking is schematized by the arrow 52 in FIG. 2.

Figure 3:
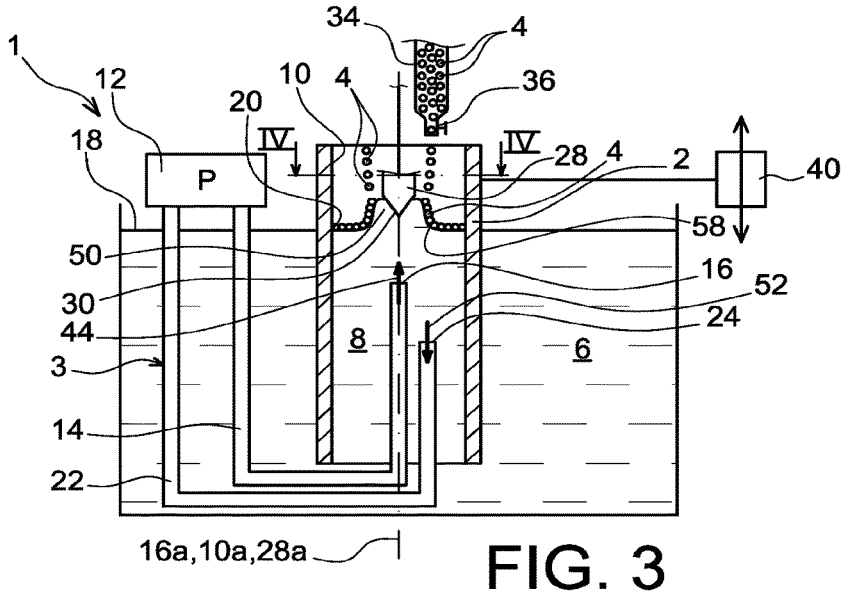
Figure 4:
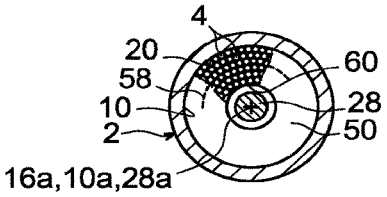
Figure 5:
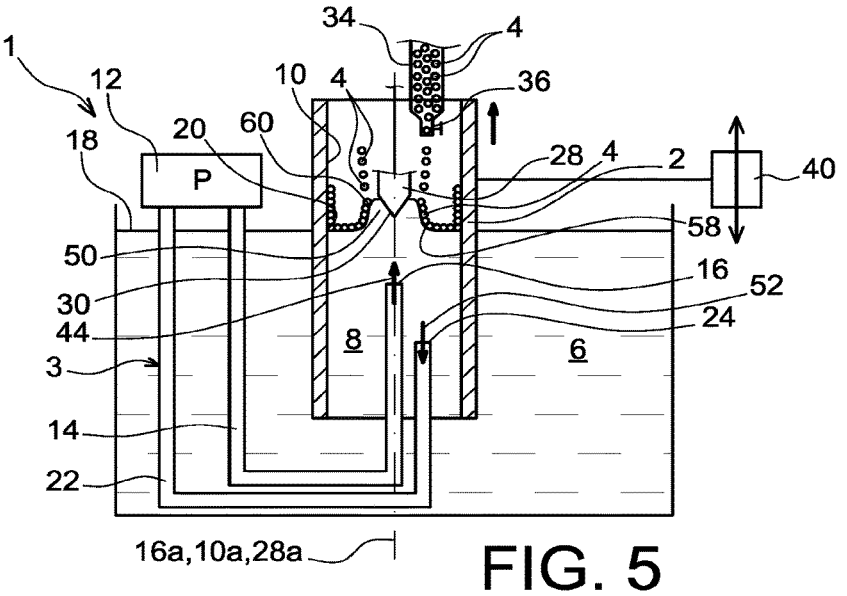

Then, in reference to the FIGS. 3 and 4, the particles 4 are dispensed at the surface 18 of the carrier liquid, and more specifically on the protuberance 50. While arriving on the same, the particles 4 are automatically directed radially outwards towards the contact line 20, because of the enhanced slope defined by the protuberance 50, and because of the current lines of surfaces also oriented radially outwards.

Gradually, the dispensed particles 4 come to be built-up against the internal surface 10 at the contact line 20 forming a stop, along the same. During this phase of triggering the compact film, the upstream front 60 of these particles tends to be radially inwardly offset, toward the axes 10*a*, 16*a*, 28*a*. The injection of particles 4 is continued even after this upstream front as gone beyond the partition line 58 of the protuberance 50, such that it raises on the slope defined by the same and the particles partly surround the same protuberance. Actually, the upstream front 60 of particles is such that it raises on the slope of the protuberance 50 such that it is located at a given vertical distance from the partition line 58, as shown in FIGS. 3 and 4. The upstream front 60 can therefore be obtained in proximity to the contact line between the external surface of the pin 28 and the liquid 6.

A this time, the solid particles 4 are ordered at the surface 18 of the carrier liquid, between the partition line 58 and the upstream front 60 arranged about the protuberance 50, for example in proximity to its apex. The ordering is automatically performed, without assistance, thanks in particular to their kinetic energy and capillary forces of which to advantage was taken upon impacting on the front 60. The ordering is such that the compact film obtained has a so-called "hexagonal compact" structure, in which each particle 4 is surrounded and contacted by six other particles 4 in contact with each other. This is called indifferently a compact film of particles, or film of ordered particles.

Once the ordered particles 4 form the desired crown at the surface of the carrier liquid, the transfer of the compact film of particles onto the internal surface 10 of the part 2 is conducted.

This step is made by displacing the part 2, namely by gradually withdrawing it from the carrier liquid, along the vertical direction. This step is schematized in FIG. 5. It is operated using means 40 directly acting on the part 2 to displace it, whereas simultaneously, dispensing the particles 4 is continued on the upstream front 60. This causes a transfer of the film onto the internal surface 10 defining the hollow of the part.

During transfer, the injection of particles and the withdrawal rate of the part 2 are controlled such that the front of particles 60 remains in a substantially identical position, which is shown in FIGS. 3 and 4. For this, the particle flow rate can be in the order of 0.1 ml/min to several tens of milliliters per minute, whereas the linear rate of the part 2, also called drawing rate, can be in the order of a few mm/min to a few hundreds mm/min.

During this drawing, the container 3 and its equipment remain fixed, only the part 2 being moved.

Figure 6:
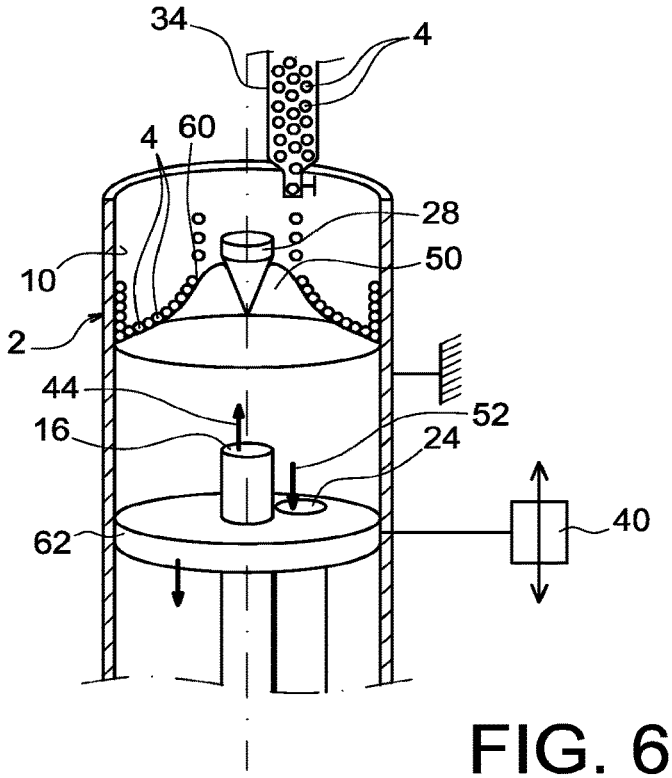
FIG. 6 represents a view similar to that of FIG. 5, according to an alternative embodiment.

In another embodiment schematized in FIG. 6, during the transfer step, the part 2 remains fixed and it is the level of the surface 18 of the carrier liquid 6 which is lowered. This is for example made using the means 40 by lowering the container and all its equipment, in particular the ports 16, 24. For facilitating the relative displacement between these elements, a mobile plate 62 can be secured to the ports 16, 24, and slide along the internal surface 10 of the part in the manner of a piston head.

Alternatively, it is possible to lower the level of the liquid 6 in the container 3 remaining fixed, for example by providing a stronger flow rate for the sucking stream 52 than for the outflow stream 44. This means gradually emptying its liquid 6 from the container 3, while holding the part fixed.

Figure 7:
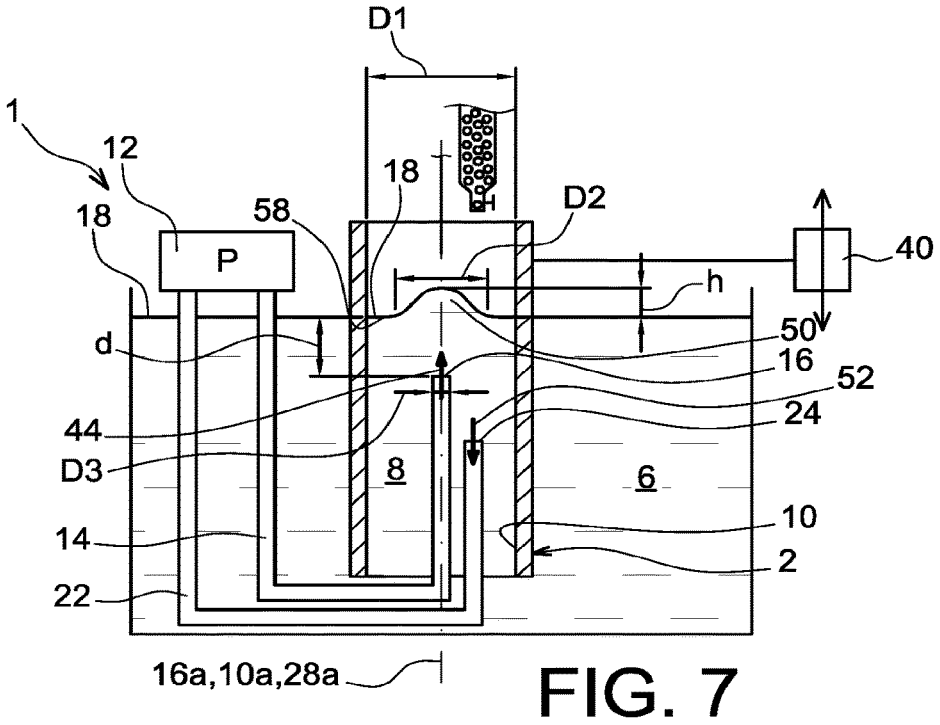
FIG. 7 represents a view of the facility shown in the previous figures, on which several dimensions have been referenced.

FIG. 7 shows several preferred dimensions for the implementation of the invention. First, the internal diameter D1 of the surface 10 of the part 2 can be in the order of 8 mm to several tens of centimeters. The diameter D2 of the partition line 58 of the protuberance 50 is for example in the order of 25 mm, whereas the vertical distance "d" between the spraying port 16 and the partition line 58 is for example in the order of 15 mm, but can be between a few millimeters and a several tens of centimeters. The height h of the protuberance 50, in a configuration without the slope enhancing pin, is for example in the order of 3 to 4 mm.

More generally, it is provided that the diameter D2 of the partition line 58 of the protuberance 50 is between 30% and 50% of the diameter D1 of the internal surface 10.

Further, the diameter D3 of the port 16 is for example between 8 mm and several tens of centimeters.

Although it is not represented in FIG. 7, it is provided that the maximum diameter of the conical pin 28 is in the order of a few millimeters to several centimeters, along the diameter D1 of the internal surface 10 of the part. More generally, the contact line between the carrier liquid 6 and the conical surface 30 has a diameter between 30% and 50% of the diameter D2 of the partition line 58 defining the protuberance 50.

The angle of the conical surface 30 with respect to the axis 28*a* of the pin 28 is for example in the order of 45°. Other values are however contemplatable, for example from 20° to 170°.

It is noted that the succession of the aforementioned steps can be repeated for depositing several superimposed films onto the internal surface 10 of the part.

Further, for depositing a film, the particles 4 utilized can be homogeneous or heterogeneous. Thus, the nature and/or dimension of the particles 4 dispensed can vary during the deposition of a same layer, depending on the actual needs. Analogously, the deposition can be interrupted along the internal surface 10, and then resumed.

Finally, it is also possible to deposit, by conventional techniques, one or more compacts films of particles onto the external surface of the part 2.

Several applications are possible for the invention described above.

It is for example the field of lighting and decorative objects. The deposition of the compact film of particles is then preferably made so as to create an iridescent effect. It can for example consist in coating the internal surface of a bulb to provide it with this iridescent effect. For this, silica microspheres can be used, for example with a diameter of about 1 μm. By changing to a diameter of about 0.3 μm, an opalescent effect is created.

The invention can also be applied to the field of structuring internal surfaces. By way of indicating example, the internal surface of the heat exchanger tubes with coolants, by being structured, enables the exchange area with the fluid passing through this tube to be increased. In the present case, the particles deposited onto the internal surface of the tube allow to act as focusing lenses for subsequently etching the substrate with a laser. The particles can here be of quartz, polystyrene or silica.

In the field of mechanics, it is also possible to structure the internal surface of parts to improve their friction coefficient. The structuring therefore is performed by plasma etching through a mask of particles, preferably spherical silica particles. This principle can for example be applied in piston liners.

Also in the medical field, the inverse opal-type structuring can be applied on some sensors of particular chemical species. The inverse opal structuring is made inside tubes through which a liquid flows. The periodical porosity of the inverse opal is then functionalized to sense at the surface the chemical species being searched for, likely to be contained in the liquid. The sensing of this species in the porosity of the inverse opal periodical structuring consequently modifies the optical response of the opal (diffraction). This response is then detected and analysed, so as to conclude about the presence or not of the chemical species searched for.

Of course, various modifications can be provided by those skilled in the art to the invention just described, only by way of non-limiting examples.

The invention claimed is:

1. A process for depositing a compact film of particles on an internal surface of a part including a hollow delimited by the internal surface, the process comprising:

a) placing the part in a carrier liquid to define a contact line between a surface of the carrier liquid and the internal surface of the part;

b) generating a carrier liquid stream in the hollow of the part towards the surface of the carrier liquid, such that the surface of the carrier liquid has a protuberance;

c) dispensing the particles at a surface of the carrier liquid to generate a compact film of particles floating on the carrier liquid between the contact line and an upstream front of particles arranged around the protuberance; and d) transferring the compact film of particles onto the internal surface of the part by operating a relative displacement between the part and the surface of the carrier liquid, while continuing dispensing the particles on the upstream front surrounding the protuberance at the surface of the carrier liquid.

2. The process according to claim 1, farther comprising placing, in the protuberance, an element for enhancing a slope defined by the protuberance, the slope enhancing element including an external surface with a cross-section narrowing in a direction opposite to that of the carrier liquid stream generated in the hollow of the part.

3. The process according to claim 2, wherein the protuberance and the enhancing element are coaxial, or centered in the hollow of the part.

4. The process according to claim 1, wherein the generating the carrier liquid stream in the hollow includes using a liquid spraying port arranged in the hollow.

5. The process according to claim 4, wherein the spraying port is covered with one or more grids.

6. The process according to claim 1, further comprising, simultaneously with the generating the carrier liquid stream in the hollow, sucking the carrier liquid, or sucking the carrier liquid by a sucking port arranged in the hollow.

7. The process according to claim 1, wherein the transferring d) is implemented by displacing the part.

8. The method according to claim 1, wherein the transferring d) is implemented by lowering the surface of the carrier liquid in the part remaining fixed.

9. The process according to claim 1, wherein the dispensing the particles c) is made using one or more optionally movable nozzles.

10. The process according to claim 1, wherein the part is tubular.

11. The process according to claim 1, wherein the particles have a major diameter in an order of 1 nm to 500 μm.

12. The process according to claim 1, wherein the compact film of particles deposited onto the internal surface of the part is homogeneous or heterogeneous.

13. The process according to claim 1, wherein a) to d) are repeated for depositing plural superimposed films.

14. The method according to claim 1, further comprising depositing a compact film of particles onto the external surface of the part.

15. A facility for implementing the process according to claim 1, comprising:

a container holding the carrier liquid;

means for generating the carrier liquid stream in the hollow of the part, towards the surface of the carrier liquid;

means for dispensing the particles at the surface of the carrier liquid; and means for operating a relative displacement between the part and the surface of the carrier liquid.

* * * * *